US005228432A

United States Patent [19]

Kaiser et al.

[11] Patent Number: 5,228,432

[45] Date of Patent: Jul. 20, 1993

[54] CONTINUOUS PASSIVE MOTION ORTHOSIS DEVICE FOR A LIMB

[75] Inventors: Robert T. Kaiser, Mount Laurel, N.J.; George Telepko, Fort Washington, Pa.; Vero Ricci, Collingswood, N.J.; Robert J. Drozdowski, Langhorne, Pa.; Berdj C. Kalustyan, Moorestown, N.J.

[73] Assignee: Jace Systems, Inc., Moorestown, N.J.

[21] Appl. No.: 760,291

[22] Filed: Sep. 16, 1991

[51] Int. Cl.[5] ..... A61H 1/02

[52] U.S. Cl. ..... 128/25 R; 128/25 B

[58] Field of Search ..... 128/25 R, 25 B, 26

[56] References Cited

U.S. PATENT DOCUMENTS

| | | | |
|---|---|---|---|
| 3,760,801 | 9/1973 | Borgeas | 128/25 R |
| 4,509,509 | 4/1985 | Bouvet et al. | 128/25 R X |
| 4,520,827 | 6/1985 | Wright et al. . | |
| 4,549,534 | 10/1985 | Zagorski et al. | 128/25 R |
| 4,566,440 | 1/1986 | Berner et al. | 128/25 R |
| 4,601,468 | 7/1986 | Bond et al. . | |
| 4,603,687 | 8/1986 | Greenwood | 128/25 R |
| 4,621,620 | 11/1986 | Anderson | 128/25 R |
| 4,637,379 | 1/1987 | Saringer | 128/25 R |
| 4,665,899 | 5/1987 | Farris et al. | 128/25 R |
| 4,671,257 | 6/1987 | Kaiser et al. | 128/25 R |
| 4,751,917 | 6/1988 | Ruf | 128/25 R |
| 4,825,852 | 5/1989 | Genovese et al. | 128/25 R |
| 4,834,073 | 5/1989 | Bledsoe et al. | 128/25 R X |
| 4,922,892 | 5/1990 | Akcelrod et al. | 128/25 R |
| 4,930,497 | 6/1990 | Saringer | 128/25 R |
| 4,974,830 | 12/1990 | Genovese et al. | 128/25 R |
| 5,129,873 | 7/1992 | Henderson et al. | 482/127 X |

*Primary Examiner*—Richard J. Apley
*Assistant Examiner*—Linda C. M. Dvorak
*Attorney, Agent, or Firm*—Panitch, Schwarze, Jacobs & Nadel

[57] ABSTRACT

A continuous passive motion orthosis device for a limb having pivotally connected first and second body portions. The device includes a base having a proximal end and a distal end. A first carriage member receives the first body portion and is pivotally connected to a second carriage member which receives the second body portion. The second carriage member is also pivotably connected to the base. A drive mechanism moves the first carriage member between the distal and proximal ends of the base. A speed control device controls the velocity of the first carriage member between the distal and proximal ends of the base such that the first carriage member pivots about the first support pivot axis with respect to the second carriage member at a predetermined angular velocity. A biasing mechanism is provided to assist the drive mechanism in lifting the limb. The second carriage member includes a plate for receiving the second body portion of the limb and is mounted such that the plate moves with respect to the second carriage member thereby compensating for different sizes and shapes of various patients, for any misalignment due to the limb shifting during therapy, or possible misalignment at initial setup by the therapist.

7 Claims, 6 Drawing Sheets

CONTINUOUS PASSIVE MOTION ORTHOSIS DEVICE FOR A LIMB

FIELD OF THE INVENTION

The present invention relates to exercise devices and, more particularly, to a device which passively and continuously exercises the joint of a human patient.

BACKGROUND OF THE INVENTION

In the past, postoperative and post-trauma treatment of patients's joints commonly included immobilization. The affected joints were fixed by casts or traction for an extended duration. As a result of such immobilization various medical problems commonly arose. In particular, capsular, ligamentous and articular adhesions, thromboembolism, venos stasis, post-traumatic osteopenia, peripheral edema, muscle atrophy, and the like were commonly attributed to the immobilization.

It is now known that immobilization related medical problems could be reduced or eliminated by early mobilization of the affected joint. It has been found to be advantageous to initiate joint mobilization immediately following orthopedic surgery, in many instances in the operating and recovery rooms while the patient is still under anesthesia. Specifically, continuous passive motion of the affected joints have been found to be effective in reducing or eliminating the above-referenced medical problems, promoting faster healing, reducing the amount of pain and medications, improving the range of movement of the affected joint after recovery, and the like.

Continuous passive motion devices (CPMs) are typically motor driven and are designed to exercise a particular joint by repeatedly extending and flexing the joint. The CPMs are capable of applying continuous motion to the joint in a consistent manner and can be adjusted to operate at different speeds and within a defined range of motion. In such CPMs, it is important that the joint be anatomically aligned on the CPM. The limb is typically secured to a moveable carriage member which is driven by the motor. The carriage member includes a plate or other softgoods for directly receiving the limb. Straps or the like are used to secure the limb to the plate or softgoods.

Conventional CPMs are problematic in that the plate or softgoods for receiving the limb are rigidly secured to the carriage member. Thus, conventional CPMs cannot mechanically compensate for any misalignment of the patient's anatomical pivot points on the CPM. Therefore, conventional CPMs work in opposition to anatomical alignment causing the patient's leg to compromise its natural motion. A need has arisen for a carriage member which includes a plate for receiving the limb which is permitted to move with respect to the carriage member and thereby compensate for different sizes and shapes of various patients, misalignment due to the patient's leg shifting during therapy, or possible misalignment at initial setup by the therapist.

Other CPMs have drawbacks in that they lack the requisite amount of power to raise and bend a relatively heavy limb. Many patients, such as a football player or perhaps a short non-flexible patient, can easily exceed the lifting capacity of conventional CPMs. Presently, this problem has been addressed by a machine which includes a large double reduction gear head that is supported by an external stand attached to the frame of a hospital bed. This machine exceeds seventy-five pounds in weight and is hard to move from patient to patient. Consequently, a need has arisen for a CPM which has the requisite power required to raise and bend a relatively heavy limb without increasing the overall size and weight of the CPM.

Conventional indirect drive CPMs drive one end of the carriage member at a substantially constant velocity. Because of the typical triangular configuration formed between the carriage member and base of the indirect drive CPMs, moving one end of the carriage member at a substantially constant velocity results in an inconsistent angular velocity at the joint as it is repeatedly flexed and extended. Conventional CPMs are typically driven by electrically powered motors which have a speed that is directly proportional to the applied voltage and inversely proportional to the applied load. This usually results in speed variance that is inconsistent with patient comfort. Thus, a need has arisen for a CPM which can maintain constant angular velocity of the joint.

The present invention overcomes many of the disadvantages inherent in the above-described CPMs by providing a CPM which flexes the joint at a constant angular velocity and is capable of lifting relatively heavy limbs. The present invention is also capable of achieving consistent anatomical alignment by compensating for patients of varying size and shape, compensating for any misalignment due to the patient's leg shifting during therapy, and compensating for possible misalignment at initial setup by the therapist. Consequently, use of the present invention results in comfort to the patient as well as decreases the overall time necessary for rehabilitating the joint.

SUMMARY OF THE INVENTION

Briefly stated, the present invention comprises a continuous passive motion orthosis device for a limb. The limb is formed by a first body portion having a first end and a second end, a second body portion having a first end and a second end, and a third body portion. The first end of the first body portion is pivotably connected to the second end of the second body portion to form a first joint such that the first body portion is pivotable with respect to the second body portion about a first joint pivot axis. The device comprises a base having a proximal end and a distal end, a first carriage member for receiving the first body portion of the limb, and a second carriage member for receiving the second body portion of the limb. The first and second carriage members have respective first and second ends. A first hinge means is interconnected between the second end of the first carriage member and the first end of the second carriage member such that the first carriage member is pivotable with respect to the second carriage member about a first support pivot axis. A second hinge means is interconnected between the second end of the second carriage member and the proximal end of the base such that the second carriage member is pivotable about a second support pivot axis. The first and second body portions are respectively positionable on the first and second carriage members such that the first joint pivot axis is generally aligned with the first support pivot axis. A drive means is interconnected between the base and the first carriage member for reciprocally moving the first carriage member between the distal and proximal ends of the base. The drive means includes speed control means for controlling the velocity of the first carriage member along the base between the distal and proximal ends thereof such that the first carriage member pivots about the first support pivot axis with respect to the second carriage member at a predetermined angular velocity.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF PREFERRED EMBODIMENT

Figure 1:
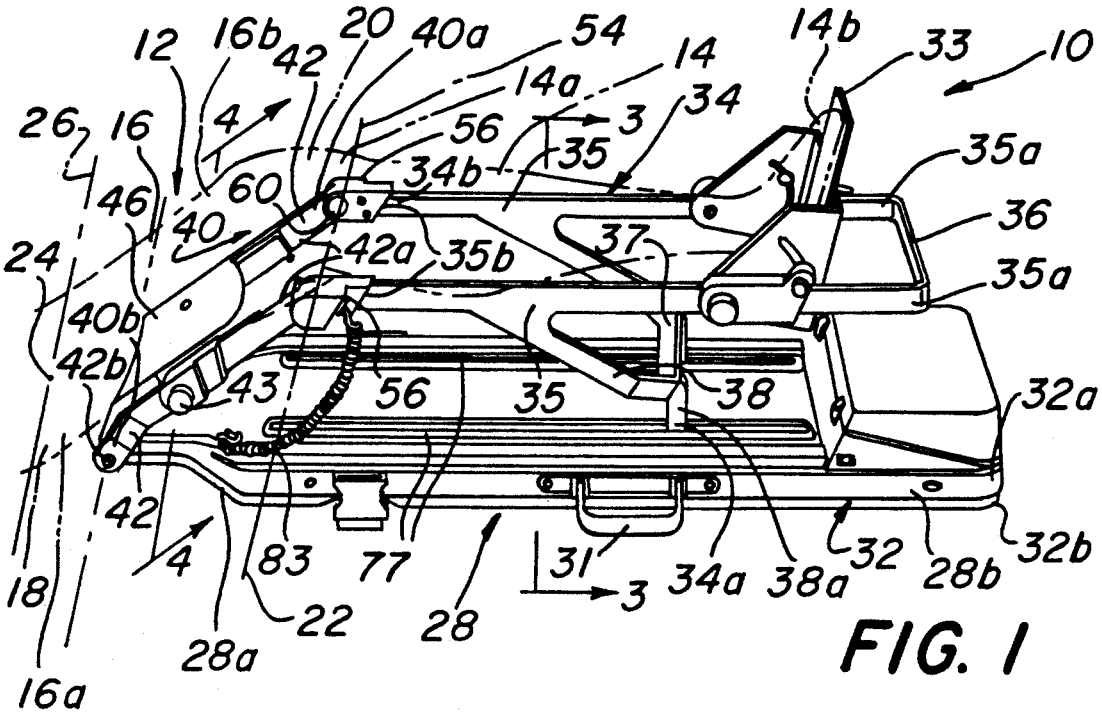
FIG. 1 is perspective view of a continuous passive motion orthosis device for a limb in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the CPM and designated parts thereof. The terminology includes the words above specifically mentioned, derivatives thereof and words of similar import.

Referring now to the drawings in detail, wherein like numerals indicate like elements throughout, there is shown in FIGS. 1 through 7 a preferred embodiment of a continuous passive motion orthosis device (CPM), generally designated 10, for a limb 12 (shown in phantom). It is preferred that the limb 12 be formed by a first body portion 14 having a first end 14*a* and a second end 14*b*, a second body portion 16 having a first end 16*a* and a second end 16*b*, and a third body portion 18. The first end 14*a* of the first body portion 14 is pivotally connected to the second end 16*b* of the second body portion 16 to form a first joint 20 such that the first body portion 14 is pivotable with respect to the second body portion 16 about a first joint pivot axis 22. The first end 16*a* of the second body portion 16 is pivotably connected to the third body portion 18 to form a second joint 24 such that the second body portion 16 is pivotable with respect to the third body portion 20 about a second joint pivot axis 26.

In the present embodiment, the limb 12 is preferably a leg and the first and second joints 20, 24 are the knee and hip joints of the leg 12, respectively. Similarly, it is preferred that the thigh and calf of the leg correspond to the second and first body portions 16, 14. It is also understood by those skilled in the art that the present invention is not limited to any particular limb. For instance, the present invention is equally applicable to the arm or any other limb of the human body or subparts thereof, such as the wrist or elbow. Moreover, the present invention is not limited to limbs having joints with a particular number of pivot axes. For example, the limb could have a joint having one, two or three pivot axes without departing from the spirit and scope of the invention. Furthermore, it is understood by those skilled in the art that the present invention is equally applicable to non-human limbs, such as the leg of a monkey or ape.

Unless otherwise indicated herein, it is understood that all of the elements of the CPM 10 are preferably constructed of a high-strength, lightweight metallic material, such as aluminum. However, it is understood by those skilled in the art that the present invention is not limited to constructing the CPM 10 of any particular material and that the CPM 10 could be constructed of other high-strength lightweight materials, such as a composite fibrous and resin material or any suitable polymeric material.

Figure 2:
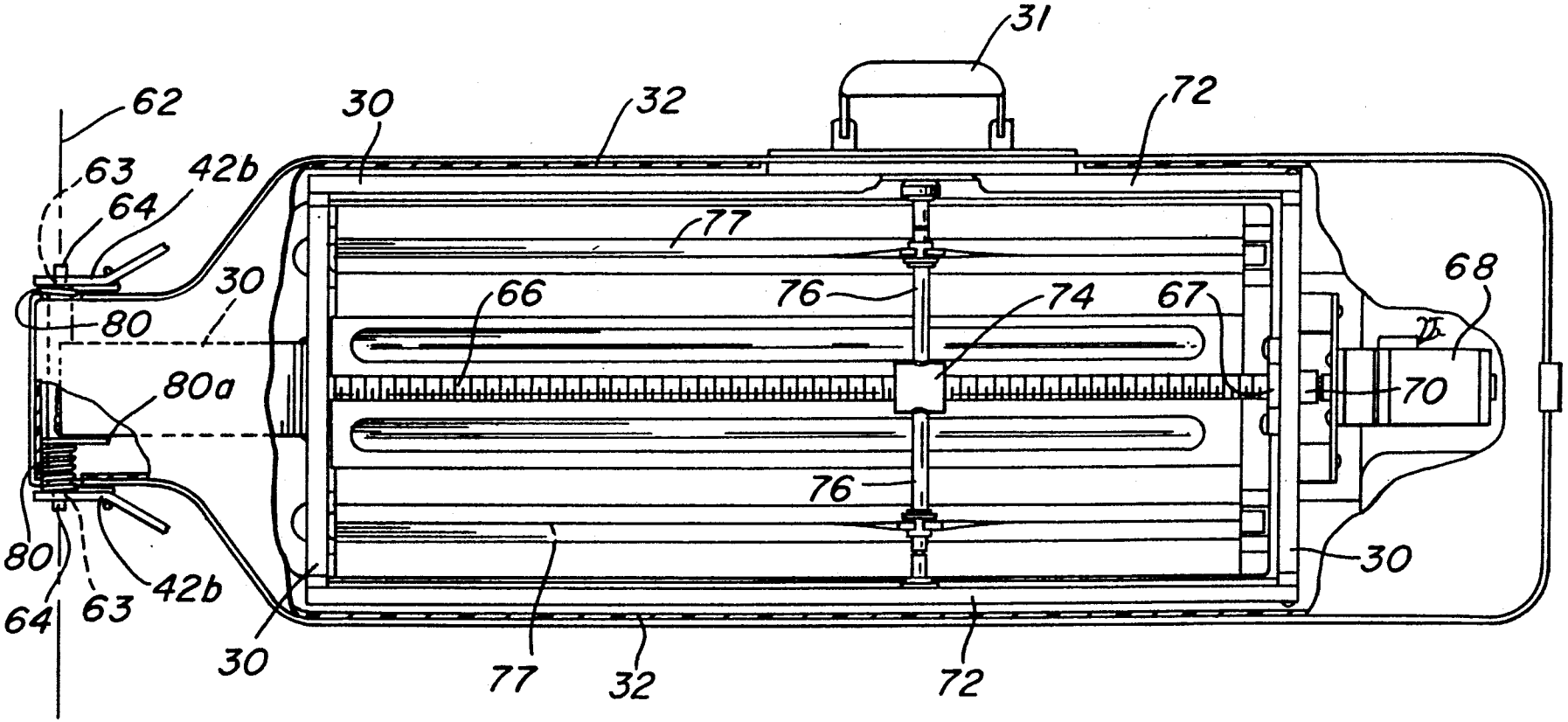
FIG. 2 is a bottom plan view, partially broken away, of the device shown in FIG. 1.

Referring now to FIGS. 1 and 2, the CPM 10 includes a base 28 having a proximal end 28*a* and a distal end 28*b*. In the present embodiment, the base 28 is preferably generally in the form of an elongate parallelepiped. The base 28 includes a frame 30 for supporting the various elements of the CPM 10. The frame 30 is encompassed within a housing 32 for providing the CPM 10 with an overall aesthetically pleasing look. The housing 32 is preferably formed of upper and lower portions 32*a*, 32*b* (see FIG. 4) and is constructed of a suitable, moldable polymeric material, such as polyvinylchloride, to decrease the overall weight of the CPM 10. The housing 32 includes a handle 31 for promoting the portability of the CPM 10. It is understood by those skilled in the art, that the housing 32 could be omitted or constructed of other materials, without departing from the spirit and scope of the invention, such as wood or a lightweight metallic alloy.

Referring now to FIG. 1, the CPM 10 includes a first carriage member 34 for receiving the first body portion 14 of the limb 12. The first carriage member 34 has a first end 34*a* and a second end 34*b*. In the present embodiment, it is preferred that the first carriage member 34 be comprised of a pair of elongate spaced generally parallel side rails 35. The side rails 35 are preferably generally linear and are spaced a sufficient distance to complementarily receive the first body portion 14 of the limb 12. The side rails 35 are connected by a transversely extending cross member 36 at the distal ends 35*a* thereof. The side rails 35 include means for receiving the second end 14*b* of the first body portion 14. In the present embodiment, it is preferred that the means for receiving the second end 14*b* of the first body portion 14 be a standard footrest 33 which is slideably adjustable along the length of the side rails 35. The side rails 35 include a proximal end 35*b* which forms the second end 34*b* of the first carriage member 34.

Figure 3:
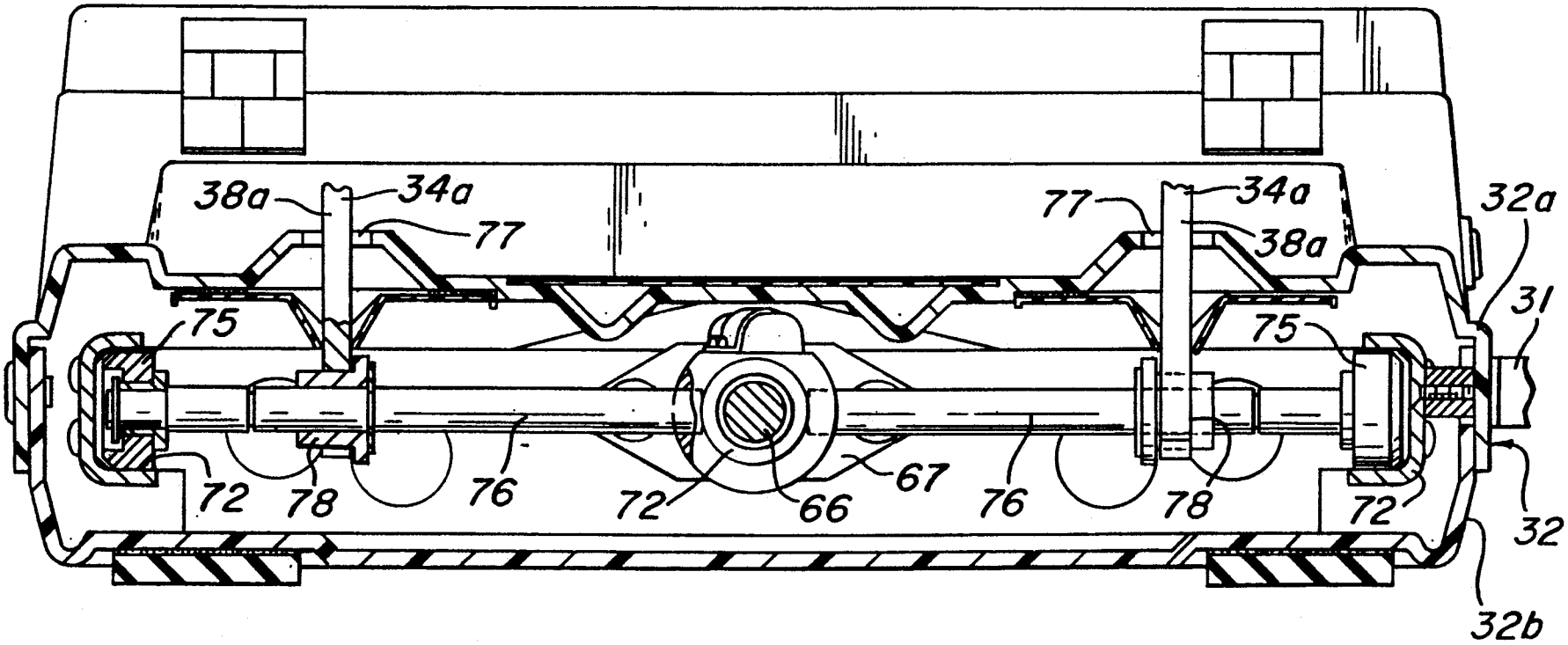
FIG. 3 is a cross-sectional view of the device shown in FIG. 1 taken along line 3—3 of FIG. 1.

Referring now to FIGS. 1 and 3, extending downwardly from the side rails 35 into the base 28 are a pair of corresponding support rods 38. The support rods 38 support the side rails 35 above the base 28 and include a cross member 37 extending transversely therebetween for providing the first carriage member 34 with structural integrity. The distal ends 38*a* of the support rods 38 form the first end 34*a* of the first carriage member 34, as described in more detail hereinafter.

As shown in FIG. 1, the CPM 10 further includes a second carriage member 40 for receiving the second body portion 16 of the limb 12. The second carriage member 40 has a first end 40*a* and a second end 40*b*. In the present embodiment, it is preferred that the second carriage member 40 be comprised of a pair of spaced generally parallel elongate support rails 42. The support rails 42 are preferably spaced a sufficient distance to complementarily receive the second body portion 16 therebetween. The support rails 42, like the side rails 35, include a cross rail 44 extending generally transversely therebetween for supporting the second body portion 16.

Each of the support rails 42 include length adjusting means for adjusting the distance between the first and second ends 40*a*, 40*b* of the second carriage member 40 to allow the CPM 10 to receive limbs of varying size. In the present embodiment, the length adjusting means is comprised of a bolt and slide mechanism 43 on the support rails 42 for allowing the support rails 42 to expand and contract t different lengths. The bolt and slide mechanism 43 is well understood by those skilled in the art and does not form any part of the present invention. Accordingly, further description thereof is omitted for purposes of convenience only and is not limiting.

Figure 4:
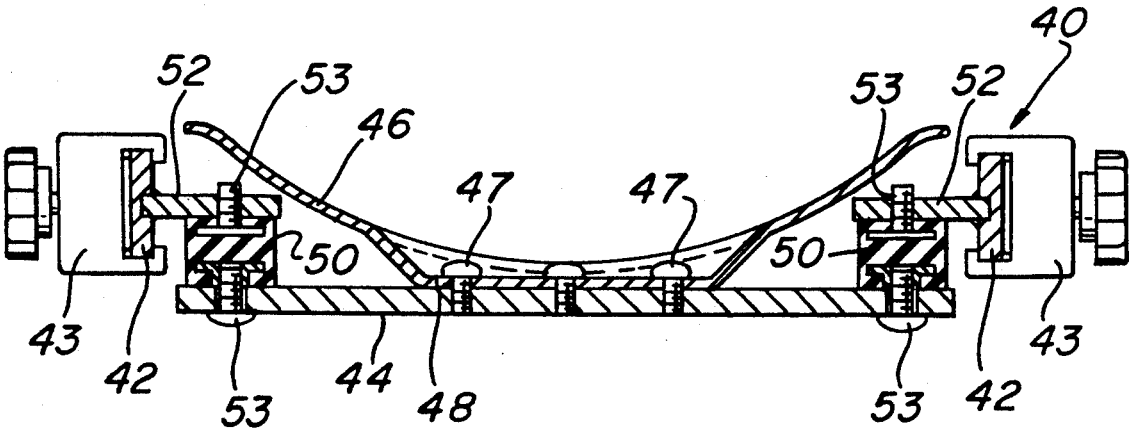
FIG. 4 is a cross-sectional view of a thigh plate for the device shown in FIG. 1 taken along line 4—4 of FIG. 1.

Referring now to FIG. 4, the second carriage member 40 includes a plate 46 mounted thereon for receiving the second body portion 16 of the limb 12. The second carriage member 40 includes flexible mounting means interconnected between the plate 46 and the second carriage member 40 for allowing the plate 46 to move with respect to the second carriage member 40. In the present embodiment, the plate 46 is configured to be contoured to the general exterior shape of the second body portion 16. A mounting member 48 extends from and is formed as part of the plate 46 and is secured to a cross rail 44 by standard fasteners, such as screws 47. The plate 46 is preferably constructed of a moldable polymeric material, such as polyvinylchloride, to reduce the overall weight of the CPM 10. However, it is understood by those skilled in the art that the plate 46 can be constructed of other materials, such as aluminum, without departing from the spirit and scope of the invention.

In the present embodiment, it is preferred that the flexible mounting means be comprised of shock absorbing elements 50 interconnected between the ends of the cross rail 44 and the support rails 42. That is, a pair of flanges 52 extend toward each other between the support rails 42 such that the flanges 52 overlap the ends of the cross rail 44. The shock absorbing elements 50 are preferably generally cylindrical and are formed of a flexible elastomeric material. The shock absorbing elements 50 are secured between the flanges 52 and the ends of the cross rail 44 by standard male and female fasteners imbedded therein, such as screws 53. The shock absorbing elements 50 allow the plate 46 to move with respect to the second carriage member 40 in many directions to assist in anatomically aligning the limb 12 on the CPM 10.

While in the present embodiment, it is preferred that the flexible mounting means be comprised of shock absorbing elements 50 interconnected between the ends of the cross rail 44 and the support rails 42, it is understood by those skilled in the art that other means can be utilized for allowing the plate 46 to move with respect to the second carriage member 40. For instance, the peripheral edge of the plate 46 could overlap the support rails 42 and a flexible material, such as an open cell foam (not shown), could be inserted between the peripheral edge of the plate 46 and the support rails 42 to achieve the same function. Consequently, it is understood by those skilled in the art that the present invention is not limited to the specific arrangement of allowing the thigh plate 46 to move with respect to the second carriage member 40 and that other methods and instrumentalities could be used to accomplish the same function.

Figure 5:
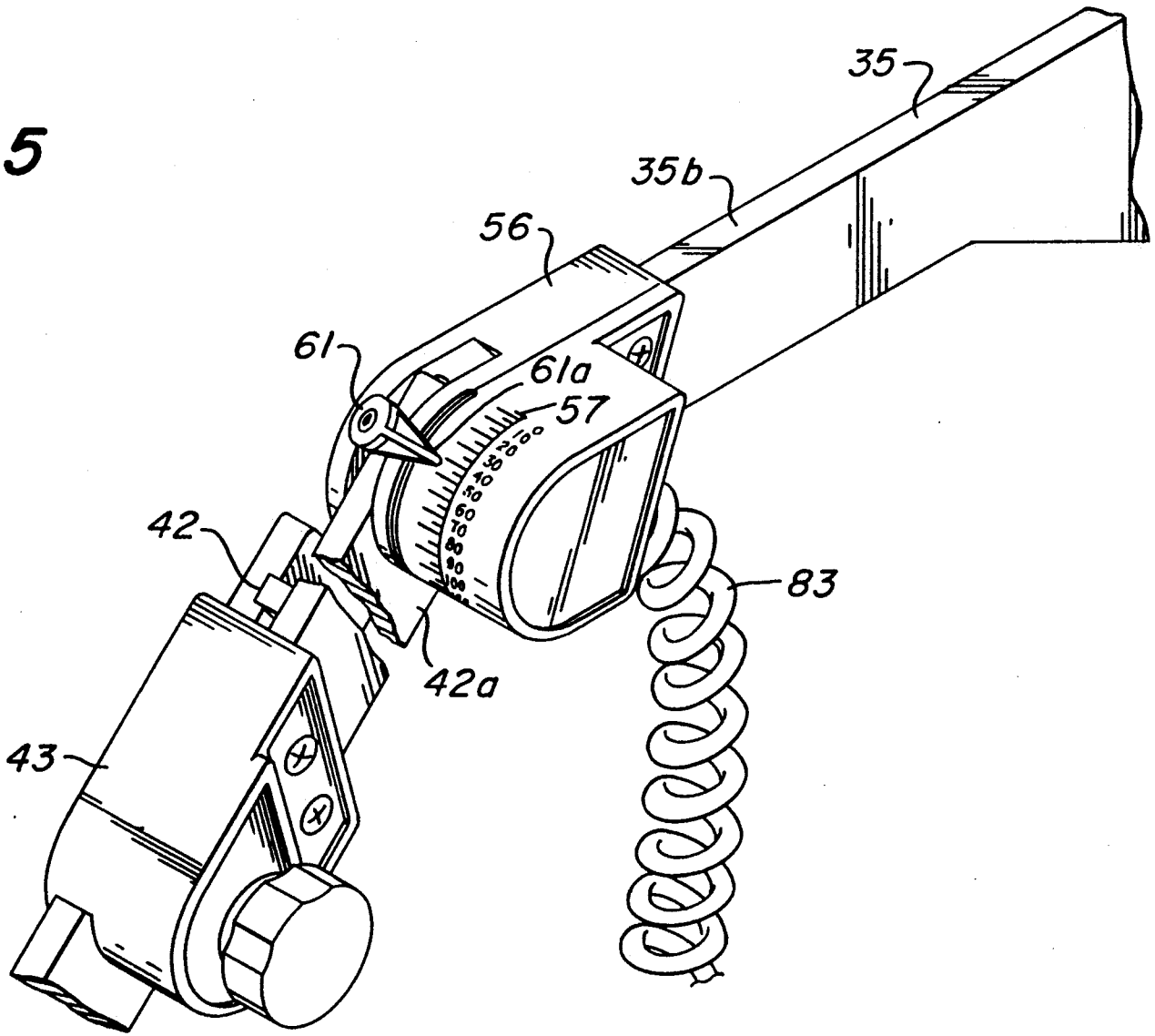
FIG. 5 is a greatly enlarged perspective view of an angle indicator for the device of FIG. 1.

Referring now to FIGS. 1 and 5, a first hinge means is interconnected between the second end 34*b* of the first carriage member 34 and the first end 40*a* of the second carriage member 40 such that the first carriage member 34 is pivotable with respect to the second carriage member 40 about a first support pivot axis 54. In the present embodiment, the first hinge means is comprised of a yoke 56 extending from each of the proximal ends 35*b* of the side rails 35 for receiving a distal end 42*a* of the corresponding support rails 42 therein. The yokes 56 and distal ends 42*a* of the support rails 42 include an aperture extending therethrough and the same are positioned in registry for receiving a pin 60 to allow the first carriage member 34 to pivot with respect to the second carriage member 40. It is understood by those skilled in the art that the present invention is not limited to any particular means for allowing the first and second carriage members 34, 40 to pivot with respect to each other. For instance, the first end 40*a* of the second carriage member 40 could include a yoke (not shown) extending therefrom for receiving the second end 34*b* of the first carriage member 34.

Referring now to FIG. 5, the yoke 56 includes an angle indicator strip 57 adhesively secured to the face thereof. The angle indicator strip 57 includes a series of marked gradations which correspond to the angular position of the first carriage member 34 with respect to the second carriage member 40. A pointer 61 extends radially outwardly from the distal end 42*a* of the support rail 42 between the legs of the yoke 56. The pointer 61 includes a transversely extending finger 61*a* which overlaps the angle indicator strip 57. The position of the finger 61*a* with respect to the angle indicator strip 56 provides the therapist and/or patient with feedback regarding the angle of the first joint 20.

Referring now to FIGS. 1 and 2, the CPM 10 includes a second hinge means interconnected between the second end 40*b* of the second carriage member 40 and the proximal end 28*a* of the base 28 such that the second carriage member 40 is pivotable about a second support pivot axis 62. In the present embodiment, it is preferred that the second hinge means be comprised of a standard pin connection between the frame 30 of the base 28 and the second end 40*b* of the second carriage member 40. More particularly, each support rail 42 includes an aperture 63 extending through the proximal end 42*b* thereof for receiving a pin 64 therethrough. The pin 64 is secured to the proximal end 28*a* of the base 28 for allowing the support rails 42 to pivot with respect to the frame 28. It is understood by those skilled in the art that the present invention is not limited to any particular type of means for allowing the second carriage member 40 to pivot with respect to the frame 28.

As best shown in FIG. 1, the first and second body portions 14, 16 are respectively positionable on the first and second carriage members 34, 40 such that the first joint pivot axis 22 is generally aligned with the first support pivot axis 54. The first and second body portions 14, 16 are secured to the respective carriage members 34, 40 by straps or the like (not shown). Further details of the method for securing the first and second body portions 14, 16 to the first and second carriage members 34, 40 are well understood by those skilled in the art and, therefore, further description thereof is omitted for purposes of convenience only and is not limiting.

Referring now to FIGS. 2 and 3, there is shown drive means interconnected between the base 28 and the first end 34*a* of the first carriage member 34 for reciprocally moving the first end 34*a* of the first carriage member 34 between the distal and proximal ends 28*a*, 28*b* of the base 28. In the present embodiment, it is preferred that the drive means be comprised of an elongate screw 66 disposed within the frame 30 along the longitudinal axis thereof. The ends of the screws 66 are mounted within bearings 67 secured to the frame 30 for permitting the screw 30 to rotate about its longitudinal axis.

As best shown in FIG. 2, at the distal end 28*a* of the base 28, within the housing 32, is a motor 68 which is directly connected to the screw 66 for rotation thereof. In the present embodiment, it is preferred that the motor 68 be drivingly connected to the screw 66 by a standard spline connection 70 to achieve a direct one-to-one ratio. However, it is understood by those skilled in the art that the motor 68 could be connected to the screw 66 in other manners and ratios without departing from the spirit and scope of the invention. For instance, the motor 68 could be spaced from the elongate screws 66 and a belt drive mechanism can be used to transfer torque between the motor 68 and the screw 66.

Referring now to FIGS. 2 and 3, disposed along the lateral edges of the base 28 are a pair of elongate channels 72 which are generally U-shaped in cross section. The channels 72 are preferably generally of the same length as the screw 66 and are positioned in spaced parallel relationship. The channels 72 are preferably formed as part of the frame 30. A complementary nut 74 is mounted on the screw 66. A pair of guidebars 76 extend outwardly from the nut 74 and include bearings 75 on the ends thereof which are in complementary sliding engagement with the channels 72. The guidebars 76 prevent the nut 74 from rotating with respect to the frame 30 and base 28. Consequently, when the motor 68 rotates the screw 66, the nut 74 reciprocates between the distal and proximal ends of the screw 66, as described in more detail hereinafter.

As best shown in FIG. 3, the first end 34*a* of the first carriage member 34 is secured to the guidebars 76 such that as the guidebars 76 reciprocate between the proximal and distal ends 28*a*, 28*b* of the base 28, the first carriage member 34 travels therewith. More particularly, the support rods 38 of the carriage member 34 extend downwardly through elongate slots 77 into the housing 32 and are pivotably secured to the guidebars 76 to allow the support rods 38 to rotate with respect to the guidebars 76 as they reciprocate between the proximal and distal ends 28*a*, 28*b* of the base 28. In the present embodiment, it is preferred that the guidebars 76 be generally circular in cross section for being positioned through a complementary aperture and bearing assembly 78 in the support rods 38 for allowing the support rods 38 to rotate with respect to the guidebars 76.

It is understood by those skilled in the art that other transmission devices can be used to transfer the torque of the motor 68 to the first carriage member 34. For instance, a rack and pinion arrangement could be used in place of the screw 66 and nut 74 without departing from the scope of the invention.

Referring now to FIGS. 1 and 2, the base 28 includes biasing means for biasing the first end 34*a* of the first carriage member 34 towards the proximal end 28*a* of the base 28 to assist the drive means or motor 68 in moving the first end 34*a* of the first carriage member 34 from the distal end 28*b* to the proximal end 28*a* of the base 28. In the present embodiment, it is preferred that the biasing means be comprised of a pair of torsion springs 80 interconnected between the second end 40*b* of the second carriage member 40 and the base 28. More particularly, each torsion spring 80 has a first end 80*a* secured to the frame 30 of the base member 28 and a second end 80*b* secured to the proximal second end 42*b* of the support rails 42. It is preferred that the pin 64 be disposed through each torsion opening 80 such that the torsion spring 80 is positioned between the base member 28 and the proximal end 42*b* of the support rails 42.

In the present embodiment, it is preferred that each torsion spring have a tension equivalent to approximately 120 inch/lbs. to thereby provide net lifting capacity of approximately twenty pounds at one foot from the second support pivot axis 62. It is understood by those skilled in the art that the strength of the torsion spring 80 can be different in accordance with the desired parameters of the CPM 10. It is also understood by those skilled in the art that a single torsion spring 80 could be utilized as opposed to two. Similarly, other means can be provided for biasing the first end 34*a* of the first carriage member 34 towards the proximal end 28*a* of the base 28 to assist the drive means or motor 68 in moving the first end 34*a* of the first carriage member 34 from the distal end 28*b* to the proximal end 28*a* of the base 28. For instance, a leaf spring (not shown) could be interconnected between the support rails 42 and the base 30.

Figure 6:
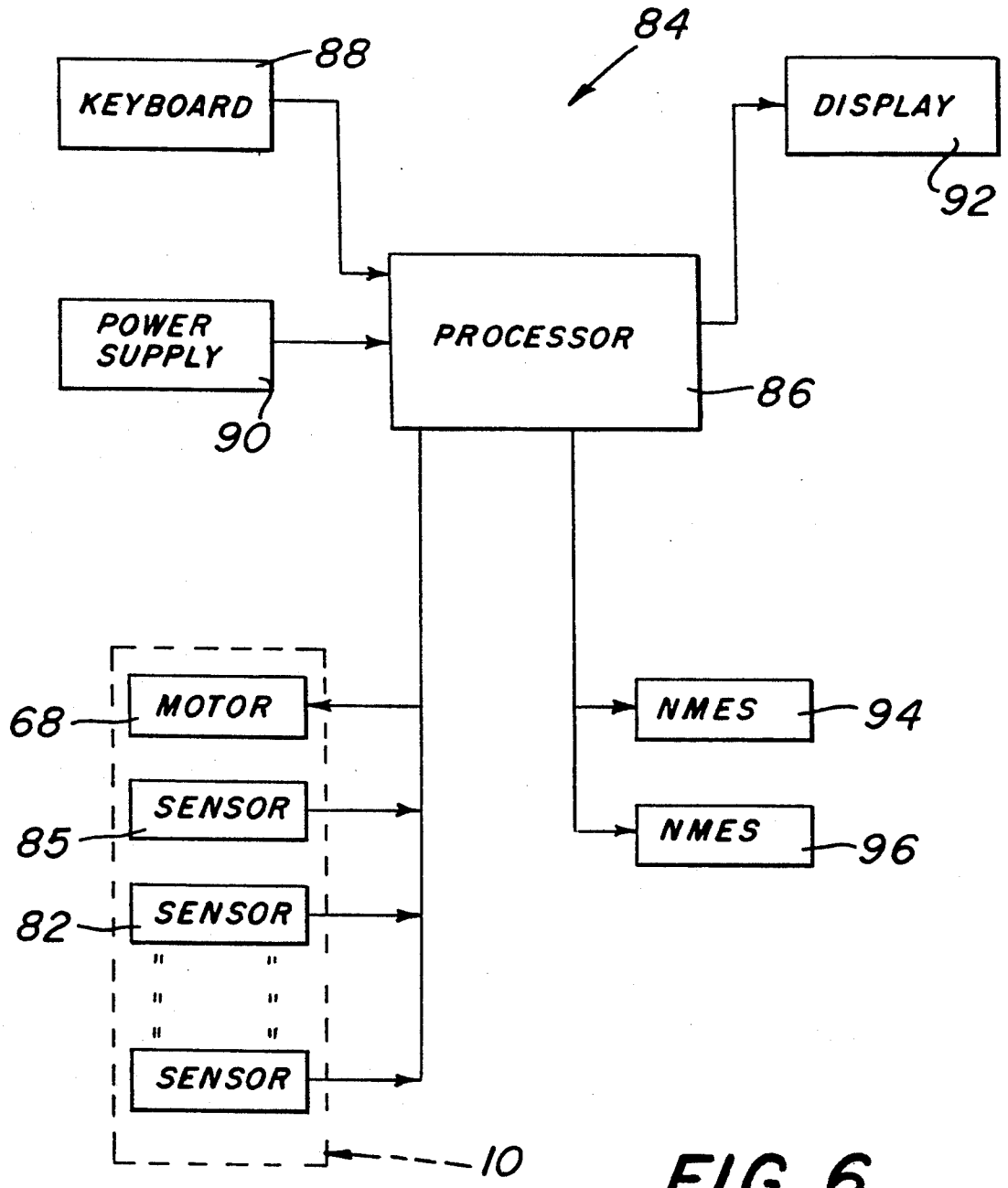
FIG. 6 is a schematic block diagram of a control system for the device shown in FIG. 1 in accordance with the present invention.

Referring now to FIG. 6, the drive means includes speed control means for controlling the velocity of the first carriage member 34 along the base 28 between the distal and proximal ends 28*b*, 28*a* thereof, such that the first carriage member 34 pivots about the first support pivot axis 54 with respect to the second carriage member 40 at a predetermined angular velocity. That is, the angular velocity remains constant throughout the range of motion of the CPM 10. In the present embodiment, it is preferred that the speed control means include angular velocity determining means for determining the relative angular velocity between the first and second carriage members 34, 40 as the first and second carriage members 34, 40 pivot about the first support pivot axis 54.

Figure 7:
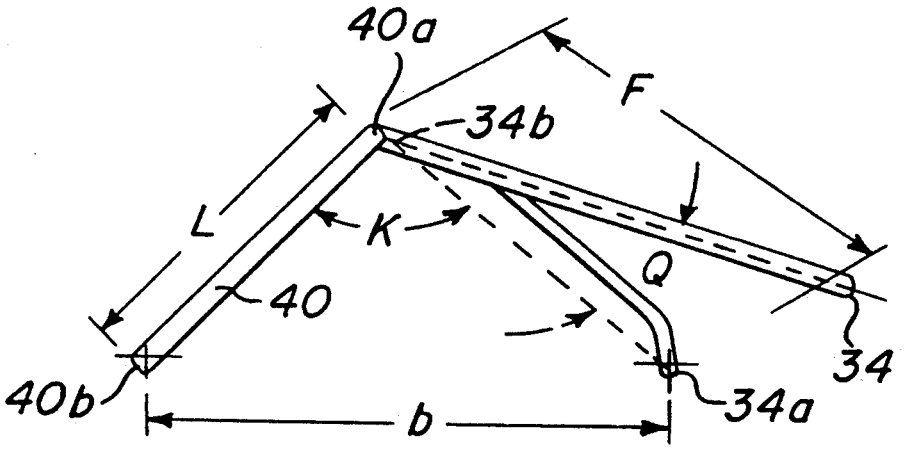
FIG. 7 is a schematic elevational view of the device of FIG. 1.

As shown in FIGS. 6 and 7, a sensor is positioned on the second carriage member 40 for determining the relative angular position of the first carriage member 34 with respect to the second carriage member 40 about the first support pivot axis 54. In the present embodiment, the sensor is comprised of an angular potentiometer 82. Angular potentiometers are well known to those skilled in the art. Accordingly, further description thereof is omitted for purposes of convenience only and is not limiting. The angular potentiometer 82 is in electrical communication through a wire 83 with a control unit, generally designated 84, which allows the therapist to control the operation of the CPM 10.

In addition to receiving signals from the angular potentiometer 82, the control unit 84 receives signals from a speed sensor 85 within the motor 68 which correspond to the actual speed of the motor. The speed sensor 85 is preferably comprised of an optical encoder (not shown) on the armature (not shown) of the motor 68. The optical encoder provides an on/off type pulse train for motor speed feedback. The encoder sends a pulse signal to an electronic board which transmits the signals to the control unit 84. The electronic board (not shown) comprises two integrated circuits. The first integrated circuit contains a voltage regulator which is connected to a 5-volt power input pin located on the control unit 84. The second integrated circuit contains an H-bridge motor driver chip which acts as a switch and is connected to the motor leads. The motor driver chip determines the direction in which the motor is rotating. The motor drive chip also acts as an on/off switch such that the motor is controlled by pulse width modulation. In addition, a safety switch is connected to the motor leads so that in the case of certain fault detections, the motor is automatically shut off.

The control unit 84 includes a microprocessor 86 for receiving signals from the angular potentiometer 82 and the speed sensor 85 associated with the motor 68. The microprocessor 86 includes suitable programming which correlates the signals from the angular potentiometer 82 and speed sensor 85 and controls the amount of voltage applied to the motor 68, and thus the speed of the same. In the present embodiment, it is preferred that the control unit 84 include an input device for inputting information into the microprocessor 86 which corresponds to the therapist's desired operation of the CPM 10. In the present embodiment, it is preferred that the input device be a keyboard or keypad 88, as is understood by those skilled in the art.

The microprocessor 86 is powered by a standard power supply 90, such as that available from an electrical wall outlet (not shown). To confirm that the desired operating characteristics are input correctly and to display operational data (e.g. speed, range of motion, etc.), the control unit 84 is provided with a display 92, such as a liquid crystal display. It is understood by those skilled in the art that other displays could be used, such as a cathode ray tube or a printer (not shown).

The microprocessor is programmed to provide comparing means for comparing a determined angular velocity with the predetermined angular velocity inputted into the control unit by the therapist or to a default predetermined velocity if desired velocity is not inputted into the control unit 84 as stored within a table within the microprocessor. The angular velocity is preferably in the range of 10°/min to 120°/min. The determined angular velocity is ascertained by the microprocessor 83 which analyzes the signals from the angular potentiometer 82 over time, as is understood by those skilled in the art. The microprocessor 86 adjusts the velocity of the first carriage member 34 along the base 28 if the determined velocity is different than the predetermined angular velocity by a preset limit, as determined by tables stored within the microprocessor. The velocity of the first carriage member 34 is adjusted such that the determined velocity is substantially equal to the predetermined angular velocity.

More particularly, the velocity of first carriage member 34 is controlled by pulse width modulation of the power supplied to the motor 68 in response to motor speed and angular position feedback from the speed sensor 85 and angular potentiometer 82. The power ON pulse width is set by the tachometer pulse indicating that the motor is in motion. The OFF pulse width is set by a transfer function that uses tachometer count during previous OFF period, present angular position, and the desired angular velocity. The control of the ON pulse assures that sufficient power is applied to overcome inertia, friction and motor reflective load. During the OFF period, the tachometer count provides an indication of motor coast which compensates for varying loads. Angular position feedback compensates for the trignometric relationship of motor speed to controlled joint angular velocity. The desired speed as determined by the user sets the nominal OFF period. Direct reading of angular position with appropriate scaling and averaging assures motions within set limits.

The present embodiment is an indirect drive orthosis device. Thus, movement of the first carriage member 34 causes a change in length of the distance along the base 28 between the first end **34*a* of the first carriage member and the second end 40*b* of the second carriage member, as shown in FIG. 8. The present invention forms a triangle formed by the length of the base B between the first end 34*a* of the first carriage member 34 and the second end 40*b* of the second carriage member 40, a leg frame F which corresponds to the linear distance between the first and second ends 34*a*, 34*b* of the first carriage member 34, and the thigh length L which corresponds to the linear distance between the first and second ends 40*a*, 40*b* of the second carriage member 40. In this configuration, at constant motor speed, the angular velocity at low knee angles K (e.g., 15° to 0°) can be significantly higher than relatively high knee angles K. This results in a feeling that the knee is in a free-fall with no support from the CPM device. This is uncomfortable and sometimes painful to the patient. In the present invention the angular velocity between the first and second carriage members 34, 40 about the first support pivot axis 54** remains relatively constant by human perception and results in comfortable motion with constant CPM support. The derivative of the base length versus the angular position results in the expression of base length velocity for constant angular velocity, also normalized to leg frame.

Referring now to FIGS. 6 and 7, the following is a description of the calculations that the microprocessor 86 should perform to derive the desired velocity of the first end **34*a* of the first carriage member 34 along the base 28 to achieve constant angular velocity at the first joint 20. The following equation correlates incremental change in the base length b to an incremental change in the angular position k of the first and second carriage members 34, 40**;

$$\frac{db}{dt} = \frac{L/F \operatorname{Sin}(K + Q)}{\sqrt{(L/F)^2 + 1 + 2\, L/F \operatorname{Cos}(K + Q)}} \frac{dk}{dt}$$

where

K=angle between first and second carriage members 34, 40 at first support axis 54

Q=drive angle

L=a linear length of second carriage member 40

F=linear length of first carriage member 34 b=base length

The first derivative of this equation yields the desired velocity of the first end **34*a* of the first carriage member 34 to achieve constant angular velocity at first joint 20 of the limb 12. However, such an equation would be too cumbersome for the microprocessor 86** to calculate.

Therefore, it is preferred to develop constants which are based on the specific geometric configuration of the CPM 20 to simplify the calculation process. In the preferred embodiment, the distance F is equal to approximately 17.60 inches and the distance L is equal to approximately 11.17 to 15.0 inches, depending on the length of the second body portion 16. For purposes of simplicity, the distance L is always assumed to be 12.5 inches. Through empirical studies, a linearized constant was developed from the slope of the velocity curve to thereby yield the following less cumbersome equation:

$$\Delta b = 12.5/17.7(K+Q+60)/(128+60)$$

The values K and Q are derived from the signals of the angular potentiometer 82 as well as standard trignometric derivations, understood by those skilled in the art. The values 128 and 60 are constants that were developed through empirical analysis. The above equation yields the change in velocity of the first end 34*a* of the first carriage member 34 to achieve a sufficient constant angular velocity at the first joint 20 such that the patient will not experience the feeling of free fall during extension of the limb.

Referring now to FIG. 6, the CPM 10 of the present embodiment can further include a pair of neuro-muscular stimulators (NMES). An NMES is an electronic device that attaches to the muscles of the limb 12 to stimulate muscle contraction or relaxation. A first NMES 94 is provided for stimulating a muscle of the limb 12 at a pause period implemented when the limb 12 is fully extended and a second NMES 96 is provided for stimulating a muscle of the limb 12 during a pause period implemented when the limb 12 is fully relaxed. The therapist decides which muscles to stimulate into contraction or relaxation. Of course, the therapist could opt to omit the use of NMES' entirely. The CPM 10 can sense stroke completion of the first carriage member 34 by measuring the angle between the first and second carriage members 34, 40 about the first support pivot axis 54 and comparing the same to the range of motion input into the control unit 84 by the operator or to a default value. Other means can be used to sense stroke completion of the first carriage member 34, such as an encoder (not shown) mounted on the screw 66 which can sense when the screw 66 stops and reverses direction. NMES' are well known to those skilled in the art and, therefore, further description thereof is omitted for purposes of convenience only and is not limiting.

It is understood by those skilled in the art that other methods or devices can be used to control the CPM 10. For instance, the controller described in the patent application entitled "Universal Controller for Continuous Passive Motion Devices," filed concurrently with the instant application, can be used to control the operation of the CPM 10 and his hereby incorporated by reference in its entirety.

In use, the patient is positioned proximate the CPM 10 with a limb 12 in engagement with the first and second carriage members 34, 40. Straps or the like are provided (not shown) for securing the first and second body portions 14, 16 of the limb 12 to the first and second carriage members 34, 40, respectively. The determined angular velocity is ascertained by the microprocessor 83 which analyzes the signals from the angular potentiometer 82 over time, as is understood by those skilled in the art. The therapist then actuates the control unit 84 and inputs the desired operating information, including angular velocity, range of motion, duration, etc. After the desired operating information is input into the control unit 84 through the keyboard 88, the therapist instructs the CPM 10 to begin operation.

Assuming the first end 34*a* of the first carriage member 34 is positioned at the distal end 28*a* of the base 28, the first carriage member 34 begins to move towards the proximal end 28*a* of the base 28 upon power being supplied to the motor 68. That is, as the motor 68 rotates, the screw 66 rotates therewith which thereby causes the nut 74 to move towards the proximal end 28*a* of the base 28. As the nut 74 moves, the first carriage member 34 moves therewith. As the first carriage member 34 moves across the base member 28, the microprocessor 86 monitors the relative angular velocity between the first and second carriage members 34, 40 about the first support pivot axis 54 as well as the speed of the motor 68. In accordance with the programming of the microprocessor 86, the microprocessor 86 performs pulse width modulation of the power supplied to the motor 68 to thereby control the speed of the motor 68 to achieve constant angular velocity between the first and second carriage members 34, 40 as they pivot about the first support pivot axis 54, as described above.

When the first end 34*a* of the first carriage member 34 reaches the proximal end 28*a* of the base 28, as sensed by the angular position of the first and second carriage members 34, 40, the microprocessor 86 actuates the first NMES 94 to stimulate a muscle on the limb 12 depending upon how the therapist set the system prior to actuation. Once stimulation is complete, the motor 68 is powered by changing the polarity of the power such that the first end 34*a* of the first carriage member 34 begins to move towards the distal end 28*b* of the base 28 at a speed to maintain the relative angular velocity between the first and second carriage members 34, 40 constant. Once the first end 34*a* of the first carriage member 34 reaches the distal end 28*b* of the base 28, the other NMES device is actuated to stimulate one of the body portions. The CPM 10 then continues in the same cycle until the desired duration of operation is complete.

From the foregoing description, it can be seen that the present invention comprises a continuous passive motion orthosis device for a limb. It will be appreciated by those skilled in the art that changes could be made to the embodiment described in the foregoing description without departing from the broad inventive concept thereof. It is understood, therefore, that the invention is not limited to the particular embodiment disclosed, but is intended to cover all modifications which are within the spirit and scope of the invention as defined by the appended claims.

We claim:

1. A continuous passive motion orthosis device for a limb, with the limb being formed by a first body portion having a first end and a second end, a second body portion having a first end and a second end, and a third body portion, the first end of the first body portion being pivotably connected to the second end of the second body portion to form a first joint such that the first body portion is pivotable with respect to the second body portion about a first joint pivot axis, the first end of the second body portion being pivotably connected to the third body portion to form a second joint such that the second body portion is pivotable with respect to the third body portion about a second joint pivot axis, said device comprising:

a base having a proximal end and a distal end, said base having a length extending between the proximal and distal ends;

a first carriage member for receiving the first body portion of the limb, said first carriage member having a first end and a second end;

a second carriage member for receiving the second body portion of the limb, said second carriage member having a first end and a second end;

first hinge means interconnected between said second end of said first carriage member and said first end of said second carriage member such that said first carriage member is pivotable with respect to said second carriage member about a first support pivot axis;

second hinge means interconnected between said second end of said second carriage member and said proximal end of said base such that said second carriage member is pivotable about a second support pivot axis, the first and second body portions being respectively positionable on the first and second carriage members; and drive means mounted to said base and directly driving said first carriage member for reciprocally moving said first carriage member between said distal and proximal ends of said base, said drive means including speed control means for automatically controlling the velocity of said first end of said first carriage member over the substantial length of said base between said distal and proximal ends thereof such that said first carriage member and said second carriage member pivot with respect to each other about said first support pivot axis at a predetermined constant angular velocity.

2. A continuous passive motion orthosis as recited in claim 1 wherein said speed control means comprises:

angular velocity determining means for determining the relative angular velocity between said first and second carriage members as said first and second carriage members pivot about said first support pivot axis;

comparing means for comparing said determined angular velocity with said predetermined constant angular velocity;

velocity adjustment means for adjusting the velocity of said first carriage member along said base if said determined velocity is different than said predetermined constant angular velocity by a preset limit, said velocity adjustment means adjusting the velocity of said first carriage member such that said determined velocity is substantially equal to said predetermined constant velocity.

3. The continuous passive motion orthosis device as recited in claim 1 further including biasing means on said base for biasing said first end of said first carriage member towards said proximal end of said base to assist said drive means in reciprocating said first carriage member from said distal end to said proximal end of said base.

4. The device as recited in claim 3 wherein said biasing means is interconnected between said second end of said second carriage member and said base.

5. The continuous passive motion orthosis device as recited in claim 1 wherein the first and second carriage members are of unequal lengths.

6. The continuous passive motion device as recited in claim 1 wherein said first and second body portions are respectively positionable on said first and second carriage members such that said first joint pivot axis is generally aligned with said first support pivot axis.

7. A continuous passive motion orthosis device for a limb, said limb being formed by a first body portion having a first end and a second end, a second body portion having a first end and a second end, and a third body portion, the first end of the first body portion being pivotably connected to the second end of the second body portion to form a first joint such that the first body portion is pivotable with respect to the second body portion about a first joint pivot axis, the first end of the second body portion being pivotably connected to the third body portion to form a second joint such that the second body portion is pivotable with respect to the third body portion about a second joint pivot axis, said device comprising:

a base having a proximal end and a distal end;

a first carriage member for receiving the first body portion of the limb, said first carriage member having a first end and a second end;

a second carriage member having a plate mounted thereon for receiving the second body portion of the limb, said second carriage member having a first end and a second end, said second carriage member including flexible resilient elements interconnected between said plate and said second carriage member such that said plate moves with respect to said second carriage member with multiple degrees of rotational freedom and multiple degrees of translational freedom, said resilient elements being constructed of a flexible elastomeric material to provide said plate with self alignment along each of said rotational and translational degrees of freedom;

first hinge means interconnected between said second end of said first carriage member and said first end of said second carriage member such that said first carriage member is pivotable with respect to said second carriage member about a first support pivot axis;

drive means interconnected between said base and said first carriage member for reciprocally moving said first carriage member between said distal end and proximal end of said base;

second hinge means interconnected between said first end of said second carriage member and said proximal end of said base such that said second carriage member is pivotable about a second support pivot axis, said first and second body portions being respectively positionable on said first and second carriage members.

* * * * *